United States Patent [19]

Landa et al.

[11] Patent Number: 5,004,165

[45] Date of Patent: Apr. 2, 1991

[54] DISPERSION APPARATUS

[75] Inventors: Benzion Landa, Edmonton, Canada; Haim Hochman, Ramat Gan; Naseem Yacoub, Herzelia, both of Israel

[73] Assignee: Spectrum Sciences B.V., Wassenaar, Netherlands

[21] Appl. No.: 400,721

[22] Filed: Aug. 30, 1989

Related U.S. Application Data

[63] Continuation-in-part of Ser. No. 306,077, Feb. 6, 1989, abandoned.

[51] Int. Cl.[5] ..... B02C 17/16

[52] U.S. Cl. ..... 241/21; 241/65; 241/135; 241/137; 241/172; 241/184

[58] Field of Search ..... 241/135, 136, 137, 146, 241/172, 184, 173, 30, 65, 66, 67, 21

[56] References Cited

U.S. PATENT DOCUMENTS

| | | | |
|---|---|---|---|
| 241,995 | 5/1881 | Kepner . | |
| 276,418 | 4/1883 | Johnson et al. . | |
| 1,370,259 | 3/1921 | Allison | 241/172 X |
| 2,204,140 | 9/1937 | Langbein . | |
| 2,792,994 | 5/1957 | Szego . | |
| 3,044,716 | 6/1960 | Frenkel et al. . | |
| 3,332,631 | 11/1964 | Wood | 241/172 |
| 3,398,900 | 11/1966 | Guba et al. . | |
| 3,511,447 | 4/1967 | Brizon . | |
| 3,679,141 | 7/1972 | Bristol . | |
| 4,039,153 | 8/1977 | Hoffman . | |
| 4,113,189 | 9/1978 | Sullivan . | |
| 4,225,092 | 9/1980 | Matter et al. . | |
| 4,496,106 | 1/1985 | Gross . | |
| 4,511,092 | 4/1985 | North et al. . | |
| 4,730,789 | 3/1988 | Geiger . | |

FOREIGN PATENT DOCUMENTS

| | | | |
|---|---|---|---|
| 21429 | 2/1935 | Australia | 241/172 |
| 445466 | 12/1974 | U.S.S.R. . | |
| 762973 | 9/1980 | U.S.S.R. | 241/172 |
| 1098564 | 6/1984 | U.S.S.R. | 241/172 |
| 1192852 | 11/1985 | U.S.S.R. | 241/172 |
| 276356 | 7/1928 | United Kingdom | 241/146 |
| 422628 | 1/1935 | United Kingdom | 241/173 |
| 848514 | 9/1960 | United Kingdom | 241/172 |
| 1577988 | 10/1980 | United Kingdom . | |

*Primary Examiner*—Mark Rosenbaum
*Attorney, Agent, or Firm*—Sandler, Greenblum & Bernstein

[57] ABSTRACT

Apparatus for dispersion of solids in liquids including two relatively movable elements arranged so as to define a dispersing volume therebetween, a multiplicity of separate generally cylindrical dispersing elements disposed within the dispersing volume, and apparatus for supplying a solid suspended in a liquid to the dispersing volume for dispersing and for removing a solid dispersed in a liquid from the dispersed volume after dispersing, wherein the relatively movable elements are separated at the dispersing volume by a separation distance which is slightly greater than the minimum dimension of the dispersing elements.

30 Claims, 6 Drawing Sheets

DISPERSION APPARATUS

REFERENCE TO COPENDING APPLICATION

This application is a continuation in part of U.S. patent application Ser. No. 306,077 DISPERSION APPARATUS, filed Feb. 6, 1989 abandoned.

FIELD OF THE INVENTION

The present invention relates to dispersion and grinding and more particularly to dispersion of solid particles suspended in liquid using cylinders, balls or the like.

BACKGROUND OF THE INVENTION

Utilization of balls for grinding is a known art. Among the known devices are ball mills, which comprise a container filled with grinding particles such as steel or ceramic balls and apparatus for stirring or agitating the balls. When particulate matter is introduced into the container, the agitation has the effect of reducing the size of the particles. The effectiveness of these devices are, in the main, limited to situations in which the particles to be ground are much smaller than the grinding particles and are suspended in a liquid.

A number of publications disclose the use in grinding of balls or other particles contained between two surfaces. In U.S. Pat. No. 276,418 there is disclosed a shoe and die for amalgamating pans in which "pulp and tailing from the battery...is ground together with quicksilver". In one of the embodiments described, grinding rollers are made to roll over a flat die.

U.S. Pat. No. 3,044,716 describes pulverizing mills in which balls are made to run in a circular raceway between two plates, the plates being entirely flat other than at the raceway. Material to be ground is fed into the center of a mill, passes through the raceway, and is ground before exiting on the periphery of the device.

U.S. Pat. Nos. 4,225,092 and 4,496,106 describe wet mills in which the grinding region is an annular volume defined between a stationary outer cylinder and a rotating inner cylinder. In both cases the annulus is filled with the material to be ground and the liquid carrier, to which are added generally spherical grinding elements having dimension much smaller than the thickness of the annulus.

U.S. Pat. Nos. 3,511,447 and 4,730,789 describe mills with attritive elements within variously configured grinding regions. The grinding regions are defined by moving and stationary surfaces and the attritive elements are much smaller than the smallest dimension of the grinding region. In both these patents there are intermediate (non-grinding) regions separating different grinding regions. During operation, the attritive elements are not present in the intermediate regions. In U.S. Pat. No. 3,511,447 the intermediate regions have a smallest dimension smaller than the smallest dimension of the elements; in U.S. Pat. No. 4,730,789 the regions have a smallest dimension slightly greater than the minimum dimension of the elements, with the elements being swept from these regions either by centrifugal or magnetic forces.

USSR Patent publication No. SU 445,466, discloses a mill for grinding ore, comprising an inner stationary truncated cone which is separated from an outer rotatable truncated cone by a plurality of crushing balls. Springs resiliently press the inner cone into engagement with the balls. Flexible material is provided on the surface of the inner cone facing the balls. In operation, material to be ground is fed through windows in a plate covering the mill and is thrown, due to centrifugal force, to the periphery of the outer cone, where it falls into a space between the two cones. The balls grind the material and the ground material then falls to the bottom and exits.

For dispersion of solids in liquids, where the mixture is highly viscous, as the solids and fluids used in the preparation of lithographic inks, three- or five-roll mills are used in which relatively large rollers, each rotating at a different speed, are almost in contact with one another, with a slight clearance between. Material fed into these mills is subjected to strong shear forces when passing between the rollers, the shear forces being operative both to reduce particle size and to improve dispersion of the solid material in the fluid.

These mills are relatively large and expensive and require considerable attention during operation. In particular, feeding, cleaning and material removal must be attended to. A further disadvantage of these mills is that the degree of dispersion achieved is often unsatisfactory, and consequently, the material must often be processed repeatedly until a desired fineness is achieved. Also, the mills are open to the atmosphere, resulting in substantial discharge of hydrocarbon vapors. Therefore, and in order to reduce health hazards and to avoid changes in ink characteristics, ink temperatures must be kept low.

SUMMARY OF THE INVENTION

The present invention seeks to provide improved apparatus and techniques for dispersion of solids suspended in liquids.

There is thus provided in accordance with a preferred embodiment of the present invention apparatus for dispersion of solids in liquids including first and second relatively movable elements arranged so as to define a dispersing volume therebetween, a multiplicity of separate generally cylindrical dispersing elements disposed within the dispersing volume, and means for supplying a solid suspended in a liquid to the dispersing volume for dispersing and for removing a solid dispersed in a liquid from the dispersing volume after dispersing, wherein said first and second elements are separated at the dispersing volume by a separation distance greater than the diameter of dispersing elements and less than twice the diameter.

Additionally in accordance with a preferred embodiment of the invention there is also provided apparatus for circulating a cooling fluid in heat exchange relationship with at least one of the first and second relatively moving elements. The apparatus for circulating preferably includes cooling pathways formed in association with at least one of the first and second relatively moving elements.

In a preferred embodiment of the invention the dispersing volume is generally annular.

There is further provided in accordance with a preferred embodiment of the present invention apparatus for dispersion of solids in liquids including first and second relatively movable elements arranged so as to define a dispersing volume therebetween, a multiplicity of separate generally cylindrical dispersing elements disposed within the dispersing volume, and means for supplying a solid suspended in a liquid to the dispersing volume for dispersing and for removing a solid dispersed in a liquid from the dispersing volume after dispersing, wherein said first and second elements are separated at said dispersing volume by a separation distance which is between 2 micron and 100 microns greater than the diameter of the generally cylindrical dispersing elements.

Further in accordance with a preferred embodiment of the invention, the apparatus for supplying and removing comprises apparatus maintaining the solid dispersed in a liquid at an elevated pressure.

Further in accordance with a preferred embodiment of the invention, the apparatus for circulating comprises means for circulating a cooling fluid in heat exchange relationship with both of the first and second elements. Further in accordance with a preferred embodiment of the invention, the apparatus for circulating comprises channels formed in the first and second elements.

Further in accordance with a preferred embodiment of the invention, the dispersing volume is a generally annular volume forming a raceway for the cylindrical elements.

Further in accordance with a preferred embodiment of the invention, the dispersing volume is delimited by the first and second elements and by retaining elements associated with at least one of the first and second elements.

In accordance with a preferred embodiment of the invention the separation distance is more than 4 microns greater than the diameter of the generally cylindrical dispersing elements. In accordance with a preferred embodiment of the invention the separation distance is more than 10 microns greater than the diameter.

In accordance with a preferred embodiment of the invention the separation distance is not more than 100 microns greater than the diameter.

Further in accordance with a preferred embodiment of the invention there is provided apparatus for dispersion of solids in liquids including a shaft and a cylindrical outer sleeve associated therewith, defining an annular region therebetween, apparatus for providing relative angular velocity between the shaft and sleeve, a plurality of roller bearings disposed in the annular region and arranged in a stack axially therealong, each of the roller bearings comprising an inner raceway, a plurality of generally cylindrical rollers and an outer raceway, first and second end limit apparatus to limit the axial extent of the plurality of roller bearings and linkage apparatus operative to transmit the relative angular velocity to the inner and outer raceways.

In accordance with a preferred embodiment of the invention the linkage apparatus includes first and second clutch apparatus alternatively disposed between adjacent pairs of the plurality of roller bearings, the first clutch apparatus being rotatably constrained to the shaft and the second clutch apparatus being rotatably constrained to the sleeve.

In accordance with a preferred embodiment of the invention at least one of the end limit means includes a spring loaded stop.

BRIEF DESCRIPTION OF THE DRAWINGS

The present invention will be understood and appreciated more fully from the following detailed description, taken in conjunction with the drawings in which.

DETAILED DESCRIPTION OF A PREFERRED EMBODIMENT

Figure 1:
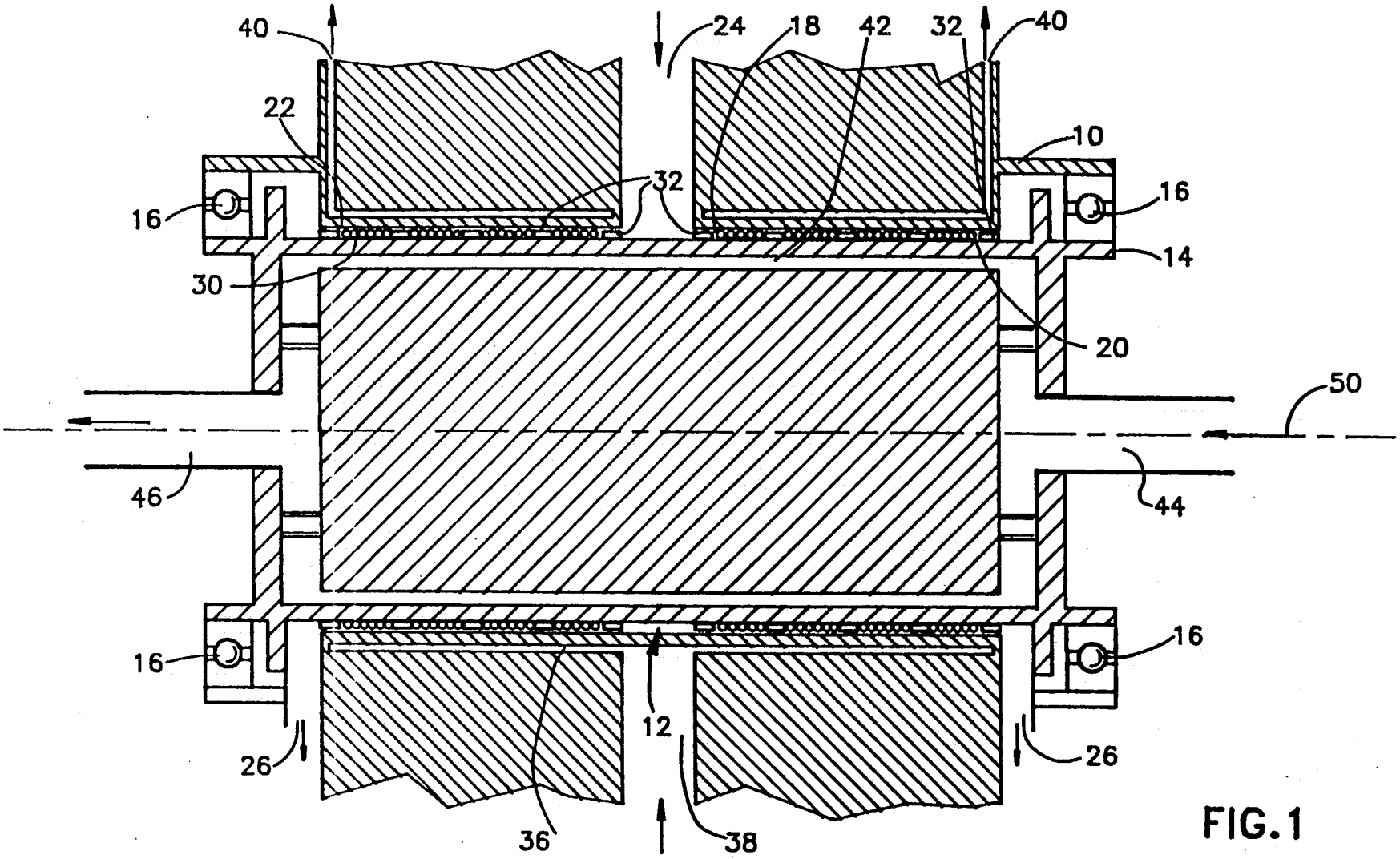
FIG. 1 is a sectional illustration of dispersing apparatus constructed and operative in accordance with a preferred embodiment of the present invention.

Reference is now made to FIG. 1, which illustrates, in section, apparatus for dispersion of solids suspended in liquids including first and second relatively moving elements arranged so as to define a dispersing volume therebetween, a multiplicity of dispersing elements disposed within the dispersing volume and apparatus for supplying a solid suspended in a liquid to the dispersing volume for dispersing and for removing a dispersed solid suspended in a liquid from the dispersing volume after dispersing, wherein the first and second relatively moving elements are separated at the dispersing volume by a separation distance which is greater than the maximum dimension of the dispersing elements.

In the illustrated embodiment, one of the first and second relatively moving elements comprises a stationary element 10 which defines a generally cylindrical bore 12 in which is rotatably mounted a rotating generally cylindrical element 14. Element 14 is rotatably mounted with respect to element 10 in bore 12 by means of bearings 16, typically as shown. An annular dispersing volume 18 is defined at bore 12 between an outer surface 20 of element 14 and a corresponding inner surface 22 of element 10.

An inlet 24 for supply of a solid suspended in a liquid, such as lithographic ink, typically extends vertically in communication with volume 18, preferably at a central location thereof, as illustrated. Outlets 26 for removal of dispersed materials are provided in communication with volume 18 at side locations thereof.

According to a preferred embodiment of the invention, surfaces 20 and 22 of the dispersing volume 18 are preferably formed of an abrasion resistant material.

In accordance with a preferred embodiment of the invention there is disposed in the dispersing volume 18 a single layer of dispersing elements 30, preferably spherical balls formed of a hard material, such as tungsten carbide and of diameter 0.8 mm. According to a preferred embodiment of the invention, the annular separation between surfaces 20 and 22 at the dispersing volume 18 is approximately between 0.005 to 0.10 mm larger than the diameter of the balls 30, preferably 0.02 to 0.07 mm.

Dispersing elements 30 are retained in volume 18 by inner and outer retaining rings 32. Additional retaining rings 32 may be provided intermediate the inner and outer rings for separating groups of elements 30 and thus subdividing the dispersing volume 18, thereby to provide enhanced resistance to the pressure of elements 30 being forced into engagement therewith. This is believed to provide improved mixing of the dispersion.

According to a preferred embodiment of the invention, cooling fluid circulation is provided through both elements 10 and 14. In element 10 an annular cooling fluid passageway 36 is defined extending in spaced, generally parallel relationship to surface 22 in communication with a cooling fluid inlet 38 and cooling fluid outlets 40. In rotating element 14, an annular cooling fluid passageway 42 is defined in spaced, generally parallel relationship to surface 20 in communication with a cooling fluid inlet 44 and cooling fluid outlet 46. It is appreciated that in this embodiment, a rotatable fluid coupling is provided in association with inlet 44 and outlet 46.

The operation of the apparatus of FIG. 1 will now be summarized. Solid particles suspended in a liquid carrier, such as for example, lithographic inks or liquid toner concentrate, is introduced under pressure, typically of 5 to 15 Bar or greater pressure, via inlet 24 to dispersing volume 18. Rotating element 14 is typically rotated relative to element 10 about an axis 50 at a relatively high speed, typically 2000–3000 RPM, by a motor (not shown).

It is believed that mainly as a result of hydrodynamic forces, the dispersing elements 30 are rotated and kept substantially non-contacting with surfaces 20 and 22. As the solid particles in the liquid carrier are forced into the space the dispersing elements 30 and surfaces 20 and 22, and in the space surrounding the elements 30, under pressure, they are subjected to high shear forces breaking up and dispersing the solid particles in the liquid carrier. The dispersed material exits via outlets 26.

Cooling fluid, typically water, is pumped through the cooling fluid passages described above, thus cooling the elements 10 and 14, and the material in the dispersing volume 18.

Figure 2:
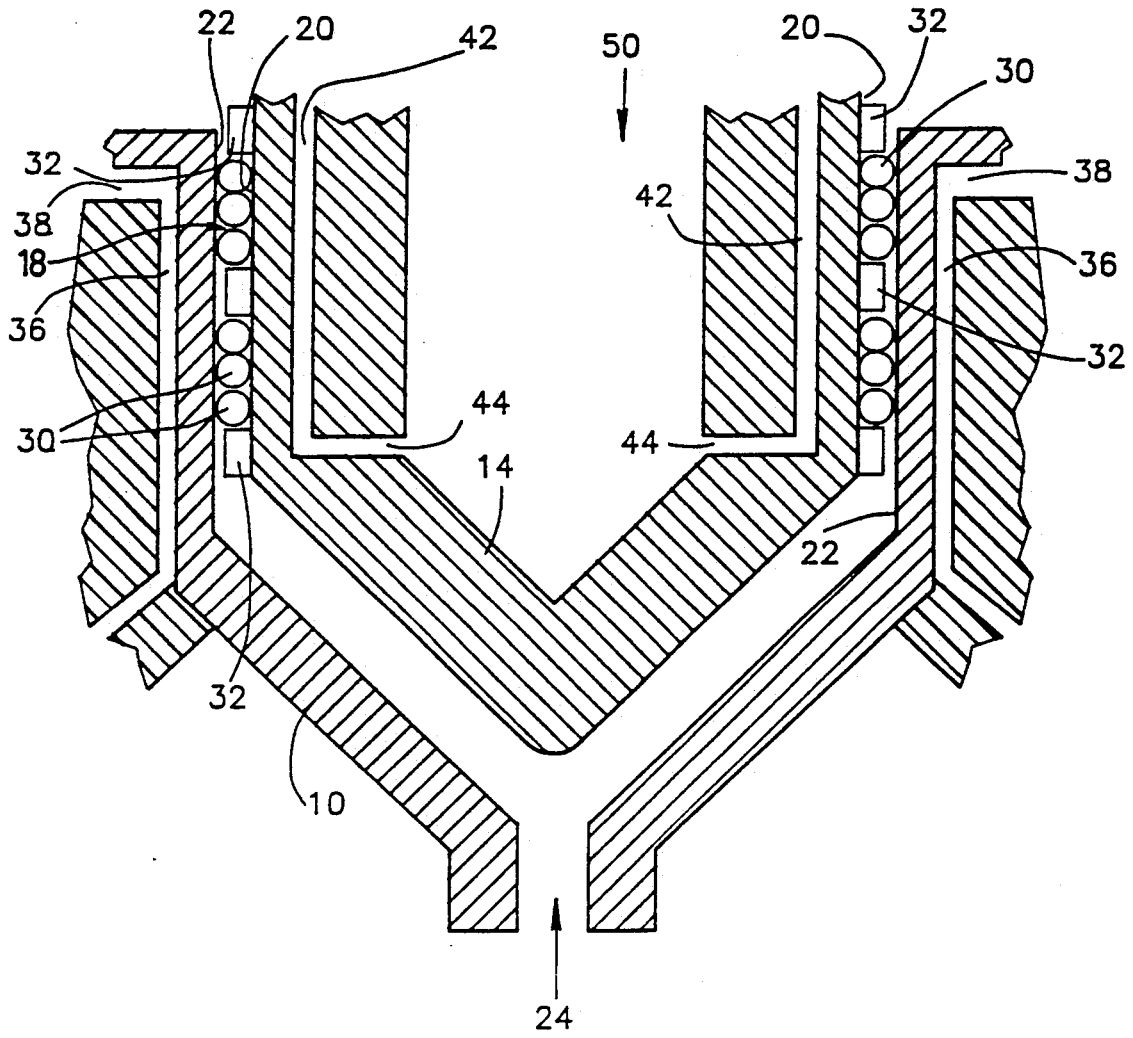
FIG. 2 is a sectional illustration of a portion of dispersing apparatus constructed and operative in accordance with an alternative embodiment of the present invention.

Reference is now made to FIG. 2, which illustrates an alternative embodiment of dispersion apparatus, wherein like features are illustrated by identical reference numerals. Here, in contrast with the operation of the apparatus of FIG. 1, the material to be dispersed is supplied under pressure to one side of the volume and removed from the opposite side, producing pressure loading on the dispersing elements 30. In the embodiment of FIG. 1, in contrast, the supply of the material to be dispersed is at an intermediate location along the volume 18.

In a practical example of the operation of the apparatus of FIG. 2, the length of the dispersing volume 18 is approximately 70 mm, the diameter of the dispersing volume 18 is approximately 70 mm, the dispersing elements 30 have a diameter of 0.80 mm and are formed of tungsten carbide, and the spacing between surfaces 20 and 22 is 0.83 mm. The apparatus is operated with an input of non-milled black lithographic ink base with a Hegman Drag reading of less than 6 at an input pressure of 13 Bar, an input material temperature of 45 degrees C. and an output temperature of 80 degrees C. and a throughput of 250 grams/minute. The rotation rate of element 14 is 2550 RPM and the power required for rotation is 10 KW. The output material has a Hegman Drag reading of between 7.8 and 8. Water is employed as a cooling fluid and circulated at a rate of about 30 liters/minute, producing a temperature rise of the water of 1.3 degrees C.

In order to clarify details, FIGS. 1 and 2 are not drawn to scale. From the example it should be noted that the annular spacing between surfaces 20 and 22 is relatively much smaller than shown. Furthermore, the number of dispersing elements is about 30,000 and not as shown.

Figure 3:
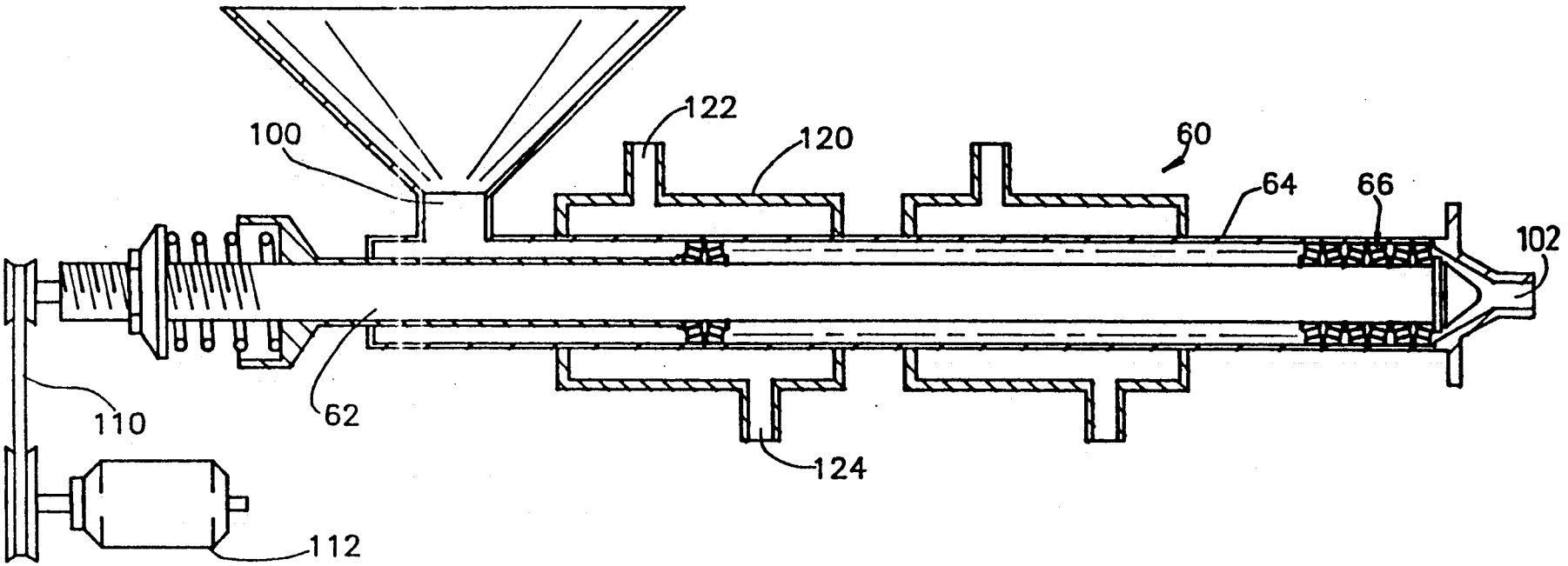
FIG. 3 is a sectional illustration of a dispersing apparatus constructed and operative in accordance with another alternative embodiment of the present invention.
Figure 4:
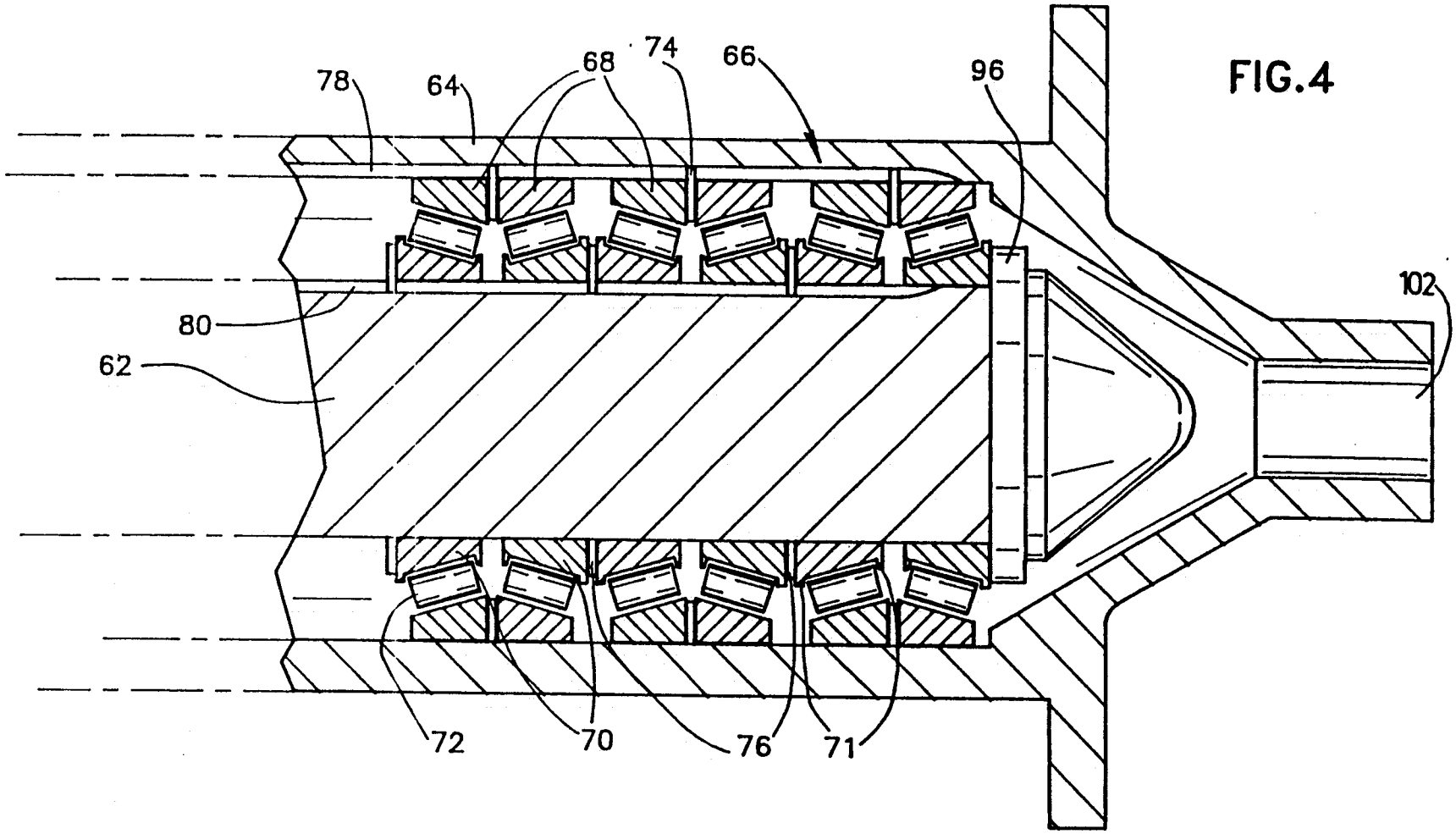
FIG. 4 is an enlarged sectional illustration of a portion of the apparatus of FIG. 3.
Figure 5:
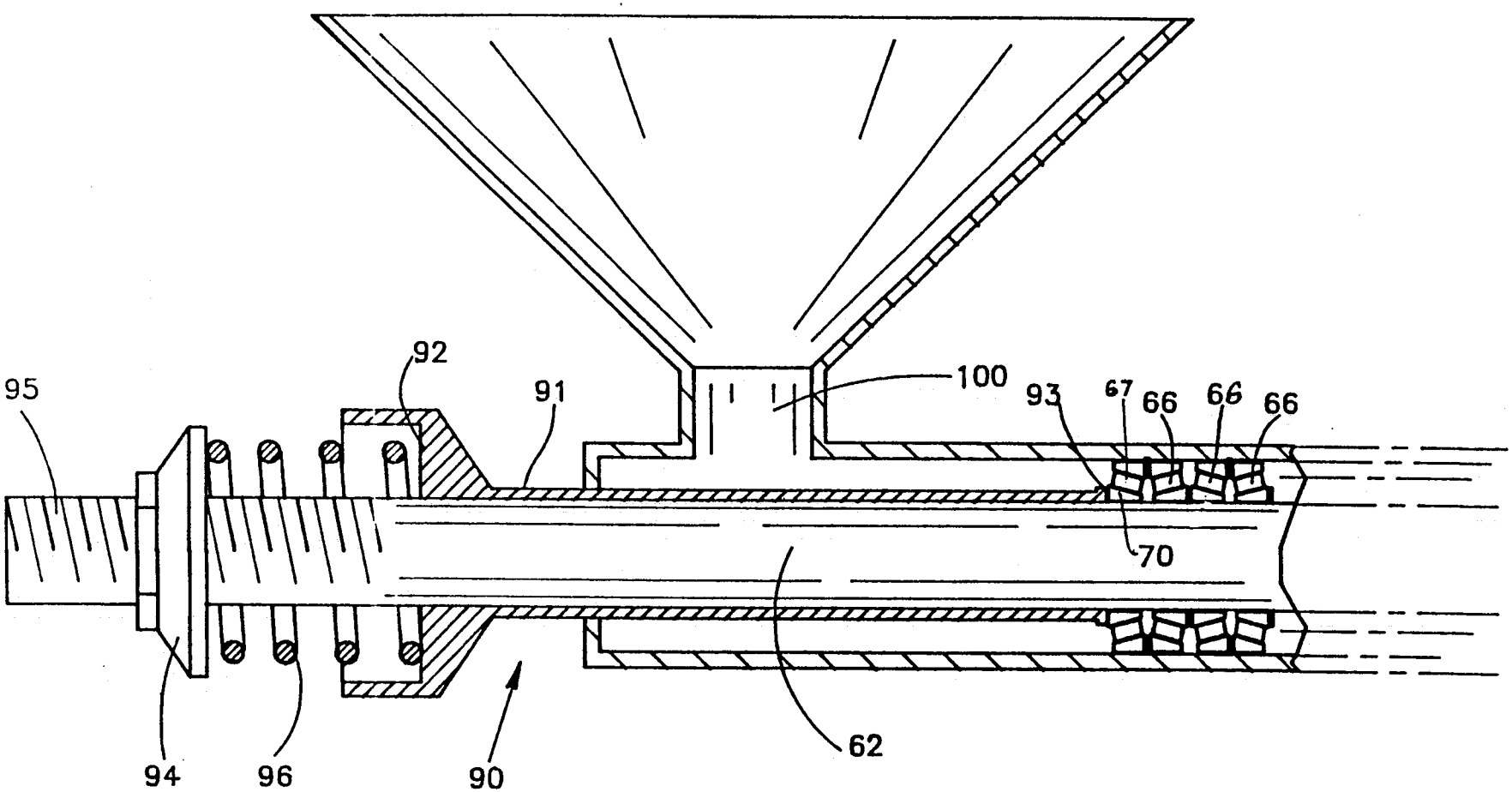
FIG. 5 is a sectional illustration of another portion of the apparatus of FIG. 3.

A third embodiment of the invention is shown in FIGS. 3 –5. Here, the dispersing elements comprise rollers which travel in a raceway formed in an annular region between a stationary outer surface and a moving inner surface.

As shown in FIGS. 3 and 4, a disperser 60 is formed of a generally cylindrical inner shaft 62 and a stationary outer cylinder 64. A plurality of roller dispersers 66 each comprising an outer conical ring 68, an inner conical ring 70 and a plurality of cylindrical rollers 72, are located in a volume defined between inner shaft 62 and outer cylinder 64. Adjacent roller dispersers 66 are spaced from each other by outer and inner annular clutch rings 74 and 76.

Inner ring 70 is formed with radial end stops 71 to form a raceway for the rollers 72, and in a preferred embodiment of the invention a retaining cage or ring (not shown) retains the rollers 72 in operative association with inner ring 70.

As illustrated in FIG. 4, alternating roller dispersers 66 are reversed in axial orientation, such that outer clutch rings 74 are abutted by outer conical rings 68 of two adjoining dispersers 66 and inner clutch rings 76 are abutted by the inner conical rings 70 of two adjoining roller dispersers 66.

Outer cylinder 64 has formed therein a longitudinal key-way 78. A key formed on the outer periphery of each of rings 74 engages key-way 78 for retaining rings 74 stationary with respect to cylinder 64. Similarly inner shaft 62 has formed therein a key-way 80 which, in conjunction with cooperating keys in inner rings 76, causes the rings to rotate together with the shaft 62.

In FIG. 5 there is illustrated an embodiment of apparatus for providing a resilient axial force to press roller dispersers 66 against adjoining clutches 74 and 76, thereby to force respective rollers 72 into pressure engagement with inner and outer rings 68 and 70 while the shaft 62 is not rotating.

A cylindrical pusher 90 is arranged to press against the inner ring 70 of the outermost roller grinder 67. Cylindrical pusher 90 comprises a cylindrical portion 91 which slides over shaft 62. One end 93 of pusher 90 contacts the outermost roller grinder 66 at the inner ring thereof and the other end defines a spring seat 92.

A threaded ring 94 is screwed onto an end threaded portion 95 of an extension of shaft 62, and in cooperation with spring seat 92 compresses a compression spring 96, thereby resiliently urging end 93 of cylindrical portion 91 against inner ring 70 of the extreme roller grinder 66.

By changing the position of ring 94 on threaded portion 95, the pressure on the roller dispersers 66 and clutches 74 and 76 can be adjusted. An end stop 96, shown in FIG. 4, provides a counter force at the other end of the stack.

Disperser 60 is provided with an inlet 100 and an outlet 102 for feeding viscous material containing particles and agglomerates to be dispersed and for removing dispersed material. An example of such material to be dispersed is non-milled lithographic ink, and the output desired is lithographic ink with finely dispersed particles.

One or more cooling manifolds 120, with cooling fluid inlets and outlets 122 and 124 are provided to allow for cooling of outer cylinder 64. Additionally or alternatively shaft cooling can be provided as illustrated in FIGS. 1 and 2.

In operation shaft 62 is caused to rotate by a belt 110 driven by a motor 112 or by any other convenient means. Pressure of inner rings 70 against inner clutches 76, causes the inner rings 70 to rotate with the shaft 62, while similar pressure causes the outer rings 68 to remain stationary. Owing to the dimensions of the moving members, cylindrical rollers 72 are made to rotate at a rotation rate many times that of shaft 62.

Upon rotation of rollers 72, because of the high viscosity of the material being dispersed, hydroplaning action results providing a force perpendicular to the interface between rollers 72 and rings 68 and 70. One component of this force acts to increase the axial extent of each of roller dispersers 66 and thus to form a gap between each of rollers 72 and adjacent rings 68 and 70. The viscous material to be dispersed passes between the inner and outer rings 68 and 70, and is disposed in the vicinity of rollers 72, and in the space between the inner and outer rings 68 and 70 and rollers 72.

In an alternative arrangement, the spring 92 is replaced by resilient solid material.

In a preferred embodiment of the invention, the spring is omitted and the threaded ring 94 is axially positioned a small distance from seat 92. Upon rotation of shaft 62, hydrodynamic forces, as described above push pusher 90 against ring 94. In this case the total roller-ring spacing is fixed by the axial position of ring 94. The division of the total roller spacing among the dispersers 66 will depend of the changes in viscosity of the material being dispersed as it travels from the inlet to the outlet.

High shear is produced in the spaces between and adjacent rollers 72 and rings 68 and 70 and causes agglomerates in the dispersion to break up and the resulting particles to be finely dispersed.

In a practical example of the embodiment of FIGS. 3–5 the diameter of shaft 62 is typically 45 mm and the inner diameter of cylinder 78 is typically 75 mm. Forty roller dispersers 66 which preferably comprise twenty spaced rollers 72 of circular cross sectional diameter of approximately 6 mm. The axis of rollers 72 form an angle of approximately 15 degrees with the axis of shaft 62.

The dispersers 66 are spaced by clutches 74 and 76 made of 2 mm stainless steel sheet. The clutches 74 and 76 may have roughened bearing surfaces, but this has not been found to be necessary, due to the high pressure forces involved.

Figure 6:
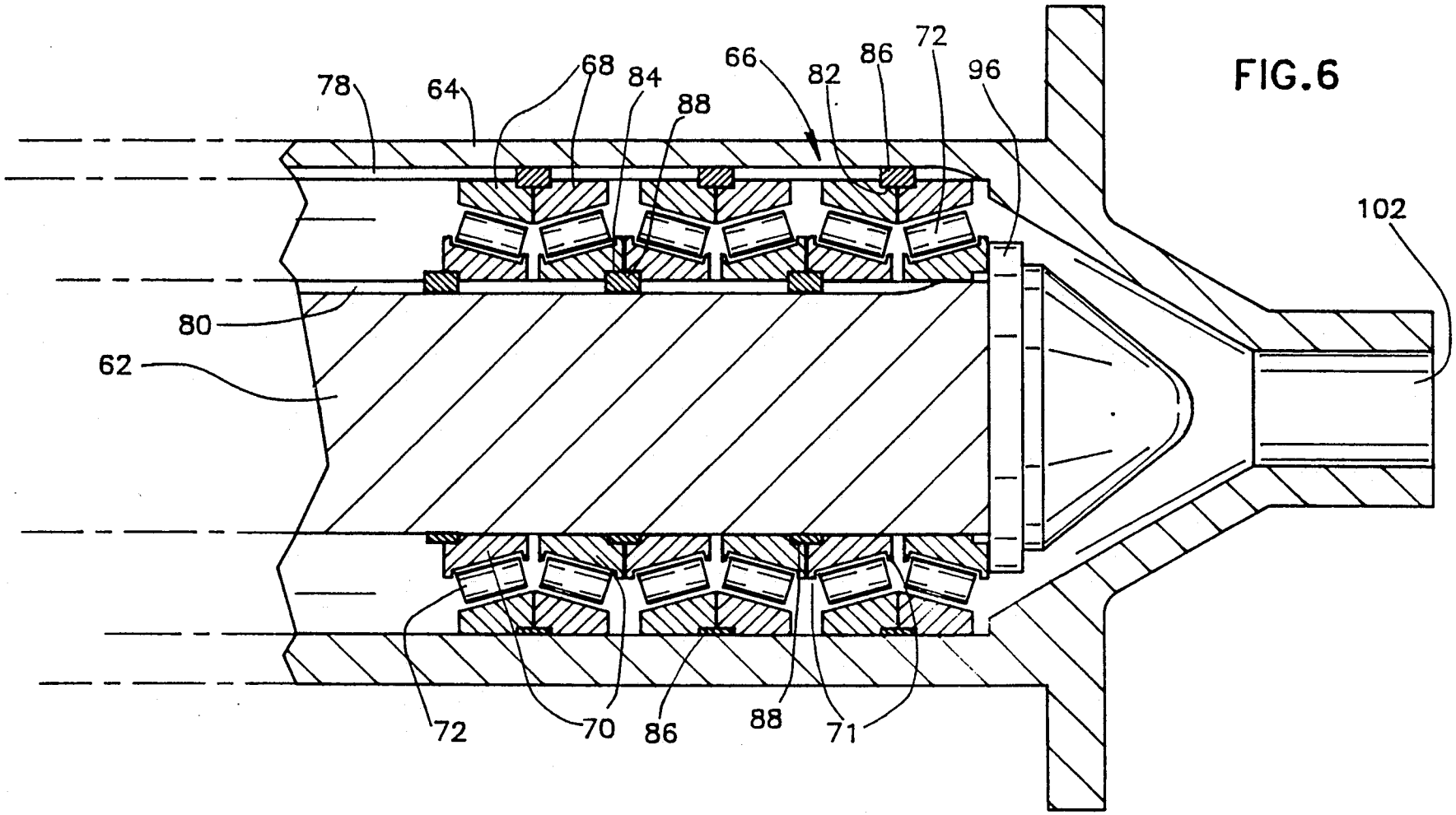
FIG. 6 is an enlarged sectional illustration of a portion of an alternative dispensing apparatus constructed and operative in accordance with another alternative embodiment of the present invention.

Alternatively, as shown in FIG. 6 the clutches may be omitted. For this embodiment of the invention an outer keyway 82 is formed in each outer ring 68 and an inner keyway 84 is formed in each inner ring 70. An inner key 86 and an outer key 88 placed in keyways 82 and 84 respectively provide for the associated outer rings 68 to remain stationary with outer cylinder 64, and for the associated inner rings 70 to rotate with shaft 62.

In a typical application, shaft 62 is rotated at about 3000 RPM, and rollers 72 rotate at a rate of about 30,000 RPM. The ink is fed into the disperser at a pressure of approximately one atmosphere. Under these conditions the power requirement is approximately 8 KW and the throughput is approximately 400 g/min., with a roller-ring spacing of approximately 5–10 microns.

It will be appreciated by persons skilled in the art that the specific dimensions, numbers of dispersers 66 and rollers 72 and rotation speed may be varied over a wide range in the practice of the invention, consistent with providing the required shear force on the dispersion.

It should be noted that proper roller-ring spacing (which may derive from proper resilient axial force or from the position of ring 90) is important to optimal operation of this embodiment of the invention. The proper force or spacing is determined empirically for each combination of parameters of the disperser structure and operation, material to be dispersed and quality of dispersion required. Too small a spacing (or too great a force causing reduced or no roller-ring clearance) results in increased power requirements and wear, well as excessive heating. Too large a spacing (or too low a force resulting in increased roller-ring spacing) results in decreased shear, producing poor dispersion.

For proper operation the spacing between the rings 68 and 70 should be 0.004 to 0.10 mm greater than the diameter of roller 72, resulting in a roller-ring spacing of 0.002 to 0.050 mm.

It will be appreciated by persons skilled in the art that the present invention is not limited by what has been particularly shown and described hereinabove. Rather the scope of the present invention is defined only by the claims which follow:

We claim:

1. Apparatus for dispersion of solids in liquids comprising:

(a) first and second relatively movable elements having respective first and second surfaces having a separation distance therebetween and arranged so as to define a dispersing volume therebetween;

(b) a multiplicity of separate dispersing elements disposed within the dispersing volume, said dispersing elements having a cross-section that is circular in shape and having a diameter which is between 2 and 100 microns less than said separation distance;

(c) means for supplying a solid suspended in liquid to the dispersing volume and for removing a dispersed form of said solid suspended in liquid from the dispersing volume after dispersing; and (d) means for effecting relative movement between said first and second surfaces whereby movement is imparted to said dispersing elements mainly by means of hydrodynamic forces created by said relative movement, thereby subjecting the solids to high shear forces operative to break up and disperse said solid in said liquid.

2. Apparatus according to claim 1 wherein said dispersing elements comprise generally cylindrical elements.

3. Apparatus according to claim 2 wherein said separation distance is greater than about 5 microns more than said diameter.

4. Apparatus according to claim 3 wherein said separation distance is between about 10 to 20 microns more than said diameter.

5. Apparatus according to claim 1 wherein said dispersing elements comprise generally spherical elements.

6. Apparatus according to claim 5 wherein said separation distance is greater than about 5 microns more than said diameter.

7. Apparatus according to claim 6 wherein said separation distance is between about 20 and 70 microns more than said diameter.

8. Apparatus according to claim 1 wherein said separation distance is between about 10 and 70 microns more than said diameter.

9. Apparatus according to claim 1 including means for circulating a cooling fluid in heat exchange relationship with at least one of the first and second relatively moving elements.

10. Apparatus according to claim 9 wherein said means for circulating includes channels formed in said first and second elements.

11. Apparatus according to claim 1 wherein at least a portion of the surfaces of said first and second elements adjoining said dispersing volume are formed with abrasion resistant characteristics.

12. Apparatus according to claim 1 wherein said dispersing volume is delimited by said first and second elements and by retaining elements associated with at least one of said first and second elements.

13. Apparatus according to claim 12 wherein means for supplying and removing includes means for supplying a solid suspended in a liquid to said dispersing volume at a location intermediate said retaining elements.

14. Apparatus according to claim 1 wherein said means for supplying and removing comprise means for maintaining the solid dispersed in a liquid at an elevated temperature.

15. Apparatus according to claim 1 wherein said separation distance is not less than about 10 microns more than the diameter of said cross-section of the dispersing elements.

16. Apparatus according to claim 1 wherein said first and second movable elements include cylindrical inner and outer surfaces that are concentrically disposed defining an annular dispersing volume.

17. Apparatus according to claim 16 wherein said dispersing elements are spherical.

18. Apparatus according to claim 1 wherein said separation distance is more than 4 microns greater than said diameter.

19. Apparatus for the dispersion of solids in liquids comprising:

(a) first and second relatively movable elements having respective first and second surfaces arranged so as to define a dispersing volume therebetween;

(b) a multiplicity of separate dispersing elements disposed within the dispersing volume;

(c) means for effecting relative movement between said relatively movable surfaces and imparting movement along said first and second surfaces to said dispersing elements mainly by means of hydrodynamic forces created by the movement between said first and second relatively movable surfaces and causing said dispersing elements to be kept substantially non-contacting with said first and second movable surfaces, and (d) means for forcing a suspension of a solid in a liquid into spaces between the dispersing elements and the first and second relatively movable surfaces and subjecting the suspension to high shear forces operative to break up and disperse said solid in said liquid.

20. Apparatus according to claim 19 wherein said first and second surfaces are concentrically disposed cylindrical surfaces defining an annular dispersal volume.

21. Apparatus according to claim 19 wherein said dispersing elements comprise generally spherical elements.

22. Apparatus according to claim 2 wherein said dispersing volume is a generally annular volume forming a raceway for said dispersing elements.

23. Apparatus according to claim 19 wherein said dispersing volume comprises a plurality of regions each delineated by said first and second surfaces and by divider elements associated with at least one of said first and second elements.

24. Apparatus according to claim 19 wherein the substantial non-contact between said dispersing elements and said relatively moving elements is mainly as a result of hydrodynamic forces.

25. Apparatus according to claim 19 wherein said means for causing relative movement between said relatively movable elements causes said dispersing elements to rotate.

26. Apparatus according to claim 25 wherein the rotation of said dispersing elements is mainly as a result of hydrodynamic forces.

27. A method for the dispersion of solids in liquids comprising the steps of:

(a) introducing a solid suspended in a liquid into a dispersing volume defined by first and second respective surfaces of first and second relative movable elements having a multiplicity of separate dispersing elements disposed within the dispersing volume;

(b) effecting relative movement between said first and second relatively movable elements; and (c) forcing said suspension into spaces between the dispersing elements and the first and second relatively movable elements, wherein said dispersing elements are kept substantially non-contacting with said first and second movable surfaces and are set in motion along said surfaces mainly by hydrodynamic forces and the suspension is subjected to high shear forces operative to break up and disperse said solid in said liquid.

28. A method according to claim 27 wherein said step of effecting relative movement causes said dispersing elements to be rotated by said first and second movable elements.

29. A method according to claim 28 wherein said rotation of the dispersing elements is mainly as a result of hydrodynamic forces.

30. A method for dispersion of solids in liquids comprising the steps of:

(a) introducing a solid suspended in a liquid into a volume defined by first and second relatively movable elements, said volume having disposed therein a multiplicity of separate dispersing elements, said dispersing elements having a crosssection that is circular in shape wherein said first and second movable elements are separated at said dispersing volume by a separation distance which is greater than the diameter of said cross-section and which is not more than 100 microns greater than said diameter; and (b) effecting relative movement between said first and second relatively movable elements and imparting movement to said dispersing elements relative to said first and second movable elements mainly by hydrodynamic forces created by the movement between said first and second movable elements thereby subjecting said solid to high shear forces operative to break up and disperse said solid in said liquid.

* * * * *

UNITED STATES PATENT AND TRADEMARK OFFICE

CERTIFICATE OF CORRECTION

PATENT NO. : 5,004,165

DATED : April 2, 1991

INVENTOR(S) : LANDA et al.

It is certified that error appears in the above-identified patent and that said Letters Patent is hereby corrected as shown below:

On the title page, Item [56], insert "Copy of International Search Report and Annex".

change "11/1964 Wood" to ---7/1967 Wood---.

At column 1, line 8, after "1989" insert ---,---.

At column 3, line 3, change "micron" to ---microns---.

At column 3, line 27, after "invention" insert ---,---.

At column 3, line 30, after "invention" insert ---,---.

At column 3, line 58, change "spring loaded" to ---spring-loaded---.

At column 4, line 50, change "abrasion resistant" to ---abrasion-resistant---.

At column 4, line 55, after "carbide" insert ---,---.

At column 6, line 4, change "3 -5" to ---3-5---.

At column 7, line 1, after "alternatively" insert ---,---.

At column 7, line 3, after "operation" insert ---,---.

At column 7, line 42, change "cross sectional" to ---cross-sectional---.

At column 8, line 12, after "wear," insert ---as---.

At column 10, line 52 (claim 30, line 7), change "crosssection" to ---cross-section---.

Signed and Sealed this

Sixth Day of April, 1993

*Attest:*

STEPHEN G. KUNIN

*Attesting Officer*

*Acting Commissioner of Patents and Trademarks*